US005960596A

United States Patent [19]

Lyons, Sr.

[11] Patent Number: 5,960,596

[45] Date of Patent: Oct. 5, 1999

[54] ROOFING MECHANISM

[75] Inventor: Robert Lyons, Sr., Hamden, Conn.

[73] Assignee: The Bilco Company, West Haven, Conn.

[21] Appl. No.: 09/103,037

[22] Filed: Jun. 23, 1998

[51] Int. Cl.[6] ..... E04D 1/36; E04D 13/14

[52] U.S. Cl. ..... 52/200; 52/58; 52/72; 52/198; 52/219

[58] Field of Search ..... 52/58, 59, 60, 52/72, 96, 198, 199, 219, 395, 200

[56] References Cited

U.S. PATENT DOCUMENTS

| | | | |
|---|---|---|---|
| 618,074 | 1/1899 | Dyer . | |
| 1,840,041 | 1/1932 | Kellogg . | |
| 1,875,640 | 9/1932 | Moore . | |
| 2,423,955 | 7/1947 | Widener . | |
| 2,851,973 | 9/1958 | Stark et al. . | |
| 3,065,572 | 11/1962 | Weingartner . | |
| 3,247,632 | 4/1966 | Bloxsom . | |
| 3,292,323 | 12/1966 | Hagan . | |
| 3,399,500 | 9/1968 | Shapiro . | |
| 3,417,527 | 12/1968 | Kiekhaefer . | |
| 3,434,250 | 3/1969 | Kiekhaefer . | |
| 3,634,984 | 1/1972 | Murphy | 52/58 X |
| 3,766,696 | 10/1973 | Tootonchie . | |
| 3,802,131 | 4/1974 | Resech . | |
| 3,838,544 | 10/1974 | Hindall . | |
| 3,901,613 | 8/1975 | Andersson . | |
| 4,112,632 | 9/1978 | Simpson . | |
| 4,409,767 | 10/1983 | Jentoft et al. . | |
| 4,462,190 | 7/1984 | Allen . | |
| 4,603,517 | 8/1986 | Lyons, Jr. . | |
| 4,781,008 | 11/1988 | Lyons, Jr. . | |
| 4,941,300 | 7/1990 | Lyons, Jr. . | |
| 5,263,287 | 11/1993 | Lyons, Jr. . | |
| 5,384,998 | 1/1995 | Tanaka et al. | 52/222 X |
| 5,553,425 | 9/1996 | Sampson et al. . | |

FOREIGN PATENT DOCUMENTS

| | | |
|---|---|---|
| 98982 | 8/1964 | Denmark . |
| 908935 | 11/1945 | France . |
| 2449176 | 10/1980 | France . |
| 579431 | 7/1933 | Germany . |
| 1509089 | 5/1969 | Germany . |
| 2832658 | 2/1980 | Germany . |
| 2951275 | 7/1981 | Germany . |
| 684055 | 3/1965 | Italy . |
| 833539 | 4/1960 | United Kingdom . |

*Primary Examiner*—Carl D. Friedman
*Assistant Examiner*—Brian E. Glessner
*Attorney, Agent, or Firm*—DeLio & Peterson, LLC

[57] ABSTRACT

A roofing device is described for attaching a roofing membrane to a roof having a curb or a parapet wall comprising a cap flashing, a top flange connected to the cap flashing and extending outward therefrom, a wall flange extending downward from the top flange. The wall flange and the top flange defining a filler channel with the curb when the cap flashing is attached to the curb. A drip edge flange extends outward from the wall flange. The roofing membrane is wrapped over an elongated resilient filler piece which is snugly inserted into the filler channel. A plurality of tabs integral with the wall flange and co-terminus with the drip edge flange, are bent towards the curb securing the filler piece and roofing membrane in the filler channel. The tabs have a tab flange which extend outward at an angle away from the curb allowing for ease of unbending the tabs to remove the filler piece when repairing or replacing the roofing membrane. Also described is a pre-manufactured roofing device including a curb piece for mounting along the perimeter of a roof or roof opening; and a pre-manufactured roofing device of suitable size and shape to be positioned on a curb, and may be manufactured in combination with a fire vent, a hatchway cover hinged to the sealing system to form a complete hatchway, or other roofing product ready for installation.

11 Claims, 2 Drawing Sheets

FIG. 1
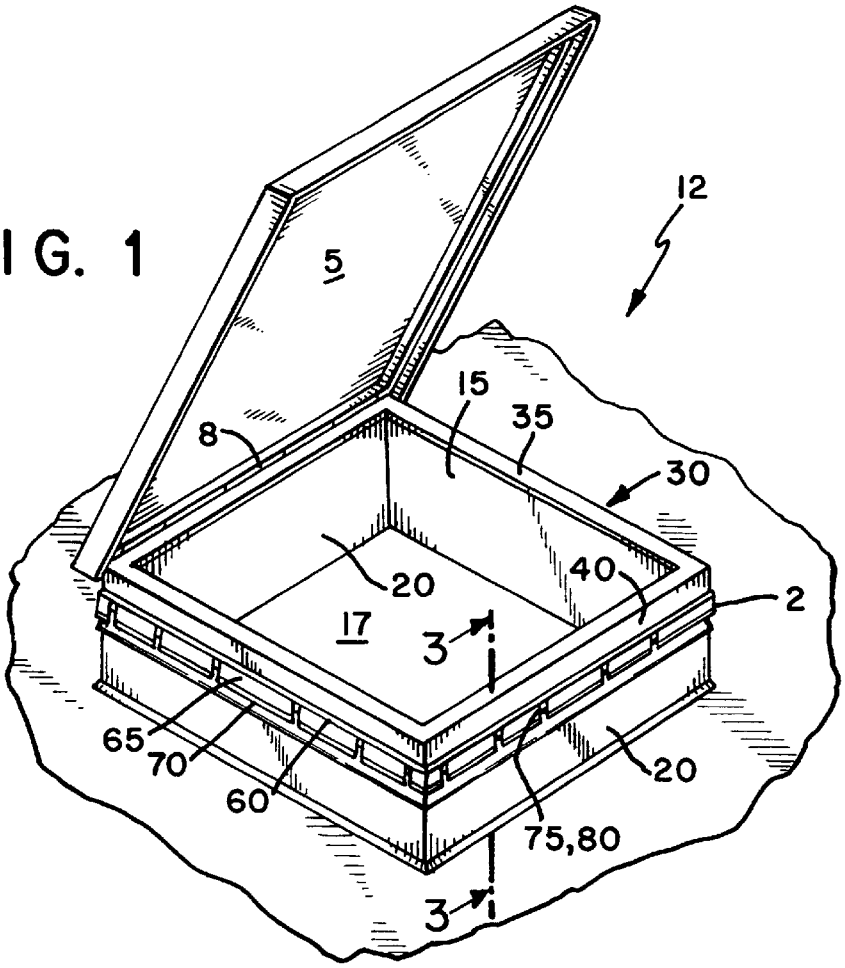
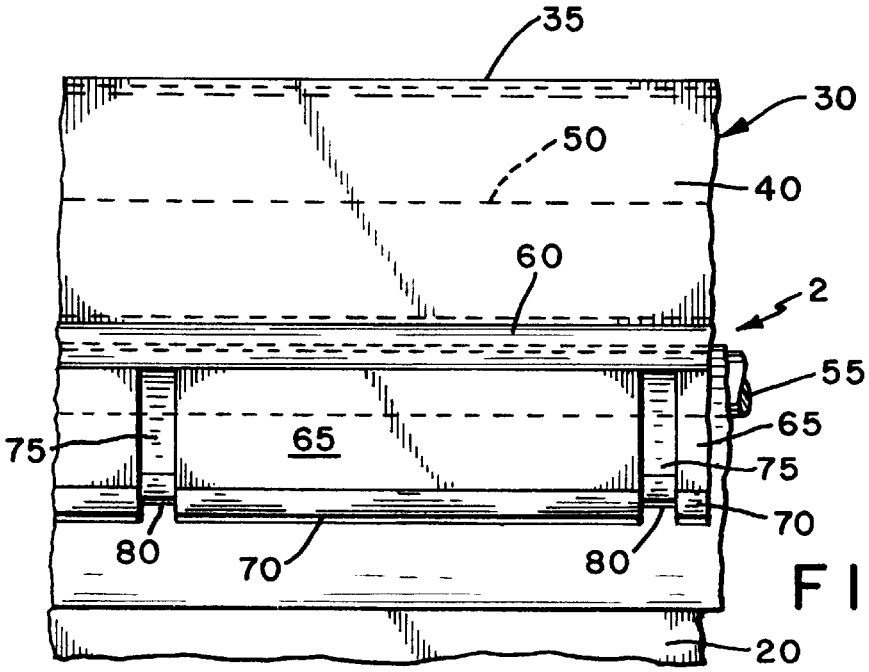
FIG. 3

ROOFING MECHANISM

BACKGROUND OF THE INVENTION

1. Field of the Invention

This invention relates to a roofing device for producing a waterproof seal between a waterproof roofing membrane and the curb surrounding a roof opening or a roof having a parapet wall. It also relates to roof hatchways employing such a roofing device.

2. Description of Related Art

Modern waterproof roofing membranes are extremely effective in providing a long lasting durable waterproof roof. To apply such a roofing membrane, rolls of the roofing membrane sheet material are unrolled to cover the surface of a roof to be sealed, and then cut to fit. Sealing of adjacent pieces of the membrane to each other with heat or adhesive form a perfectly waterproof cover for the roof. There are seldom problems encountered with such roofing membranes in the flat and unobstructed areas of the roof. However, when it is necessary to provide an opening in the roof, such as is required for a scuttle, access hatch, automatic fire vent or skylight, great care must be taken to ensure that the roofing membrane is tightly sealed to the curb wall surrounding the roof opening.

In the unobstructed areas of the roof, adjacent pieces of the roofing membrane are easily bonded together in flat, wrinkle-free seams. Because these portions of the roof are flat or only moderately inclined, the underlying roof fully supports the membrane and seams by the force of gravity that tends to hold the membrane in position.

However, at the curb surrounding a roof opening or along the parapet wall, the roofing membrane is turned around corners and up along the faces of the curb wall to maintain the waterproof seal. On these surfaces, there is no support for the roofing membrane and gravity constantly pulls on the roofing membrane, occasionally causing it to slip out of position, ultimately causing leaks. Thus, it is necessary to mechanically secure the turned-up edge of the roofing membrane near the top of the curb wall to provide support. This support is also important during installation of the roofing membrane when it is necessary to hold portions of the membrane temporarily in position before final sealing of the membrane seams.

Nailing the roofing membrane at the top of the curb is the present means of mechanical support. However, this punctures the membrane material and is often the source of leaks. Also, on the harsh exposed environment of the roof, conventional nails are prone to rusting. This requires specialized corrosion resistant fasteners supplied with the flashing accompanying a roof hatch. Unfortunately, the loose fasteners are difficult to distinguish from conventional fasteners, resulting in the substitution of non-corrosion resistant fasteners that corrode and fail.

The sealing systems in U.S. Pat. Nos. 4,941,300 and 5,263,287 disclose a sealing system with tabs that are integral with the wall flange to hold a longitudinal filler piece in a filler channel once the roofing membrane is wrapped over the filler piece. Unbending the tabs releases the filler piece from the filler channel to remove the membrane for repair, replacement, or accessing the roof underneath. The tabs permit installation of the roofing membrane without using separate fasteners that slow the operation. However, the prior art tabs do not allow for ease of removal, particularly where the curb or parapet wall is low in relation to the roof level. Also, the prior art tabs might puncture the roofing membrane if pushed in too far during installation.

Accordingly, one object of the present invention is to provide a waterproof sealing system between a roofing membrane and a curb that does not employ loose fasteners. Another object of the invention is to provide a roofing device wherein the spacing of the fasteners is even, providing good support for the membrane along the entire upper edge of its curb. Yet another object of the invention is to provide a roofing mechanism wherein the fasteners allow easy access to the roof beneath the roofing membrane, to repair, or replace the membrane. Still yet another object of the invention is to provide a roofing device which does not puncture the waterproof roofing membrane. A further object of the invention is to provide a reliable inexpensive and easily installed support for the roofing membrane at the upper edge of the curb. Still another object of the invention is to provide a pre-manufactured roofing mechanism of suitable size and shape to be positioned along the parapet wall of a roof or the perimeter of a roof opening. Still yet another object of the invention is to provide a roof hatchway, fire vent, or other roof mounted product integrated with a pre-manufactured roofing device, appropriate flashing and a curb suitable for positioning around a roof opening.

Still other objects and advantages of the invention will in part be obvious and will in part be apparent from the specification.

SUMMARY OF THE INVENTION

The above and other objects which will be apparent to those skilled in the art are achieved in the present invention which provides a roofing device for sealing a roofing membrane to a roof having a curb comprising a cap flashing having a horizontal portion and a vertical portion. A top flange, having a bottom portion, extends outward at an angle from the vertical portion of the cap flashing. A wall flange extends downward from the top flange defining a filler channel with the curb when the cap flashing is attached thereto. A drip edge flange extends outward at an angle from the wall flange. An elongated resilient filler piece is snugly inserted into the filler channel after wrapping the roofing membrane around the filler piece. A plurality of tabs, integral with the wall flange and co-terminus with the drip edge flange, are bent towards the curb at the bottom portion of the top flange. Thus, the filler piece and roofing membrane are secured within the filler channel. The tabs have a tab flange that extends outward, preferably, at the same angle as the drip edge flange allowing for easy removal of the filler piece when repairing, replacing the roofing membrane, or accessing the roof beneath the membrane.

In another aspect of the present invention, a second embodiment is a pre-manufactured roofing device comprising a base flange having vertical and horizontal portions, the horizontal portion fixedly attached to the roof. A curb piece is attached to the vertical portion of the base flange. A cap flashing, having vertical and horizontal portions, is attached by its horizontal portion to the vertical portion of the base flange. An inner support, disposed on top of the curb, is attached between the vertical portion of the base flange and the vertical portion of the cap flashing. Extending outward at an angle from the vertical portion of the cap flashing is the top flange. The wall flange extends downward from the top flange defining a filler channel with the exterior surface of the curb and the interior wall of the wall flange. A drip edge flange extends outward at an angle from the wall flange. An elongated resilient filler piece is snugly inserted within the filler channel once the roofing membrane is wrapped over the filler piece, thus, securing the roofing membrane. A plurality of tabs are integral with the wall flange and co-terminus with the drip edge flange. The tabs have a tab flange that extends outward, preferably, at the same angle as the drip edge flange.

In still yet another aspect, the present invention relates to an improved roofing device for attaching a roofing membrane to a curbed roof or roof opening having a cap flashing with vertical and horizontal portions, a top flange extending outward at an angle from the vertical portion of the cap flashing, a wall flange extending downward from the top flange, where the top flange and the wall flange define a filler channel with the curb when the cap flashing is attached to the curb, a drip edge flange extending outward at an angle from the wall flange, and an elongated resilient filler piece for snug insertion within the filler channel. The improvement lies in a plurality of tabs formed from the wall flange, the tabs being co-terminus to the drip edge flange, and having a tab flange extending outward, preferably, at the same angle as the drip edge flange.

The cap flashing, top flange, wall flange, drip edge flange, tabs, and tab flange are preferably formed from a single sheet of metal. The tabs are formed by vertically cutting the wall flange to the bottom of the drip edge flange.

In still another aspect, the present invention relates to a pre-manufactured unit of suitable size and shape to be positioned on a curb, and may be manufactured in combination with a hatchway cover hinged to the sealing system to form a complete hatchway ready for installation.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

FIG. 1 is a perspective view of a hatchway for a roof opening including the roofing device of the invention.

FIG. 3 is a front elevational view of a section of the roofing device of the present invention.

DESCRIPTION OF THE PREFERRED EMBODIMENT

Figure 2:
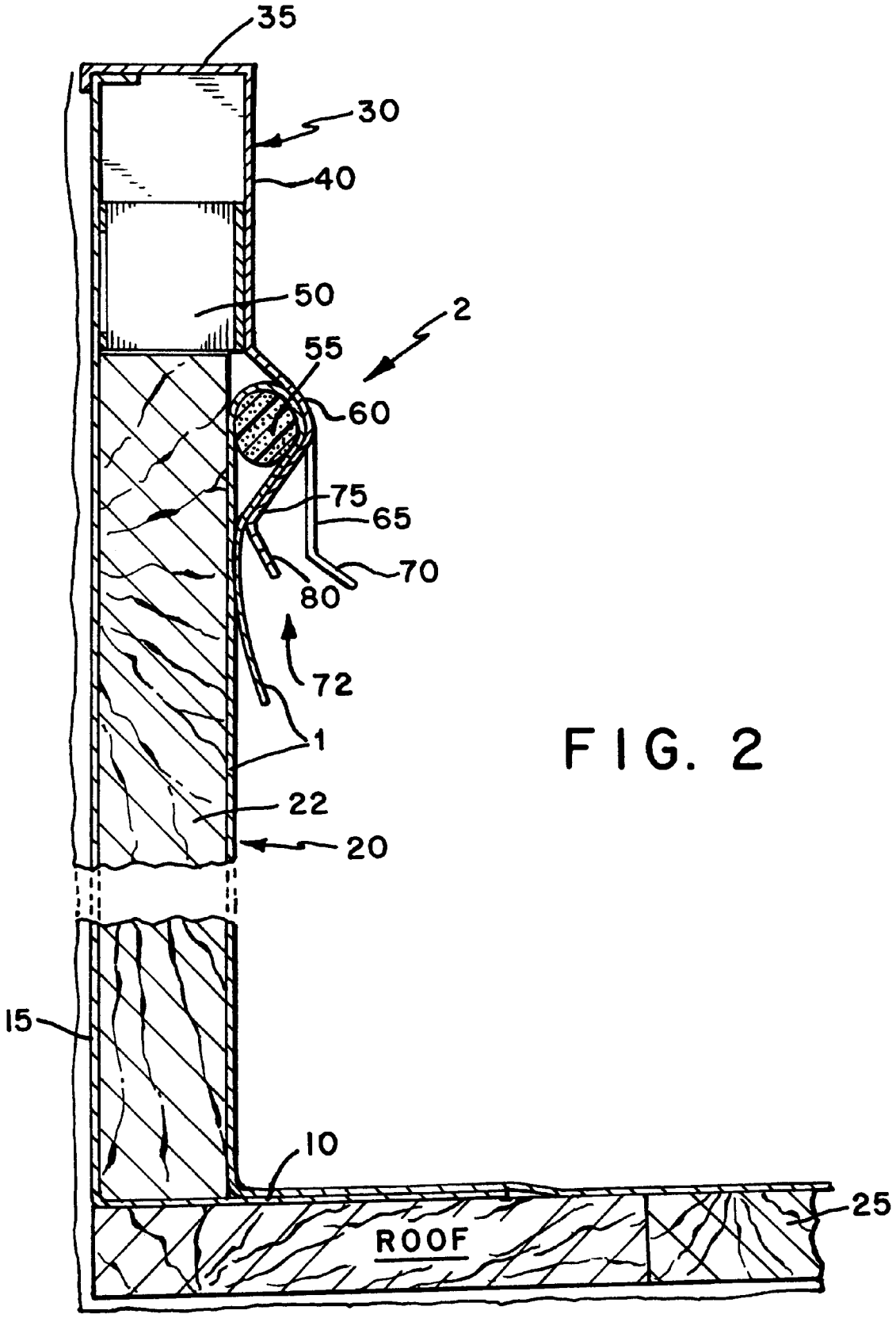
FIG. 2 is a cross sectional side view along the lines 3—3 of FIG. 1 of a preferred embodiment of the present invention.

In describing a preferred embodiment of the present invention, reference will be made herein to FIGS. 1–3 of the drawings in which like numerals refer to like features of the invention. Features of the invention are not necessarily shown to scale in the drawings.

FIG. 1 shows a perspective view of a hatchway 12 for a roof opening 17 incorporating the roofing device 2 of the present invention. The hatchway 12 comprises a hatchway cover 5 conventionally hinged along a hinge line 8 to the roofing device 2.

A preferred embodiment of the roofing mechanism of the present invention is generally referred to with reference numeral 2. The roofing mechanism is positioned on top of a curb 20 which surrounds the perimeter of the roof opening or is part of the parapet wall of a roof. The curb 20 prevents snow and rain, which may accumulate on the roof, from entering the roof opening or getting underneath the roofing membrane 1.

In the preferred embodiment shown in FIG. 2, the curb 20 may be pre-manufactured, as shown, to be part of the roofing mechanism 2. The pre-manufactured curb may be formed from wood, foam or a composition board material on its outer surface 22, and a sheet metal inner surface 15. The inner surface 15 is bent by 90° to form a base flange 10 which may be adhesively sealed and nailed or screwed in a conventional manner to the roof 25. The outer surface 22 is preferably an insulating material compatible to the roofing membrane 1 being applied.

The inner surface 15 projects above the outer surface 22 and is attached to the horizontal portion 35 of the cap flashing 30. The inner surface 15 of curb 20 is also connected to the vertical portion 40 of cap flashing 30 by an inner support 50. The inner support 50 provides structural rigidity for the cap flashing 30 and for the upper portion of the inner surface 15 of curb 20. It is preferably formed of bent sheet stock and is welded to the inner portion 15 of curb 20. The positioning of the inner support 50 on the curb 20 provides strength and support for the cap flashing 30 which must occasionally support the weight of a person climbing over the curb through a roof opening or over the parapet wall.

To seal the roof between the curb 20 and the roof 25, a roofing membrane 1 is laid on the surface of the roof 25 and wrapped up the exterior wall of the curb wall 20. A single piece of roofing membrane 1 may wrap up from the roof onto curb 20 to form a continuous unbroken seal, or separate pieces of the membrane may be applied to the curb and sealed to the roofing membrane 1 at the base of curb 20.

Also part of the roofing mechanism 2 are the top flange 60, the wall flange 65, and the drip edge flange 70, all of which are preferably formed from the same sheet of metal as the cap flashing 30. The drip edge flange 70 acts in conjunction with the wall flange 65 to direct rain away from the edge of the roofing membrane and the curb.

The cap flashing 30 is positioned on top of the curb 20 such that the top flange 60, which is connected to the bottom of the vertical portion 40 of the cap flashing 30, extends outward at an angle from the cap flashing 30 away from the curb 20. The wall flange 65 extends downward from the bottom portion of the top flange 60 forming a filler channel 72. The filler channel 72 is open at the bottom and is defined at the top by the top flange 60, on one side by the wall flange 65 and on the other side by the curb 20.

An elongated resilient filler piece 55 is provided to fit snugly within the filler channel 72. The filler piece 55 is preferably a cross linked polyethylene which is extruded as a flexible cylindrical rod having a diameter slightly larger than the distance between the exterior face of the curb wall and the inner surface of the wall flange 65. A suitable material is commonly referred to as "backer bar." This material has the advantage of being relatively inexpensive and meets the requirement of being resistant to the temperature extremes encountered on the roof while retaining its elastomeric properties. Another suitable material is extruded plastic hot water pipe.

During installation, the roofing membrane 1 is brought up the exterior face of the curb 20 and folded over the filler piece 55. The filler piece 55 is then pushed up into the filler channel 72 where it is compressed slightly between the wall flange 65 and the curb 20. The resilient nature of the filler piece 55 holds the roofing membrane 1 in the filler channel 72 while the remaining portions of the roofing membrane 1 are positioned prior to final sealing.

Referring now to FIG. 3, the wall flange 65 includes a plurality of evenly spaced tabs 75 which are integral with wall flange 65. Tabs 75 are co-terminus with the drip edge flange 70 and are formed by cutting the drip edge flange 70 through the wall flange 65 and up to the bottom portion of the top flange 60. Thus, the tops of tabs 75 are connected to the bottom portion of the top flange 60. At the end of tabs 75 are tab flanges 80 extending outward at an angle away from curb 20. Preferably, the tab flange extends outward at the same angle as the drip edge flange.

After filler piece 55 is pushed up into filler channel 72, tabs 75 are bent toward the curb 20 closing off the bottom of the filler channel 72 securely retaining filler piece 55 and roofing membrane 1 in position. The tabs 75 are bent at the bottom portion of top flange 60 and the top portion of wall flange 65. The filler channel 72 is closed off at the point where the top portion of the tab flanges 80 meet curb 20.

In order to remove filler piece 55 when repairing or replacing the roofing membrane or to gain access to the roof underneath, the tabs 75 may be unbent by inserting an instrument under tab flanges 80 or by grabbing at tab flanges 80 with pliers. Tab flanges 80 are lifted away from curb 20 opening filler channel 72 for removal of filler piece 55.

The above invention achieves the objects recited above. The present invention provides for water proof sealing between a roofing membrane and a curb or parapet wall which does not employ loose fasteners and provides even support for the roofing membrane along the entire edge of the curb. The present invention also provides for easy removal of the filler piece from the filler channel, particularly when the curb or parapet wall is low, to repair or replace the roofing membrane. Removal of the filler piece is attained by lifting the tabs by their tab flanges and inserting an instrument underneath the tabs or by grabbing the tab flanges with pliers. The present invention also provides for a pre-manufactured roofing device which includes a curb for positioning around the perimeter of a roof or roof opening where there is no existing curb or parapet wall. In addition, the present invention also provides for a pre-manufactured unit of suitable size and shape to be positioned on a curb, and may be manufactured in combination with a hatchway cover, hinged to the sealing system to form a complete hatchway ready for installation; a fire vent; or other roof mounted products.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A roofing device for sealing a roofing membrane to a roof having a curb comprising:

a cap flashing having a horizontal portion and a vertical portion adapted for watertight attachment to a vertical wall;

a top flange extending outward at an angle from the vertical portion of said cap flashing, said top flange having a bottom portion;

a wall flange downward extending from said top flange, said top flange and said wall flange for defining a filler channel with the curb when said cap flashing is attached thereto;

a drip edge flange extending outward at an angle from said wall flange;

an elongated resilient filler piece for snug insertion within the filler channel; and a plurality of tabs formed from said wall flange co-terminus with said drip edge flange, said tabs having a tab flange extending outward at the same angle as said drip edge flange and vertically cut from said drip edge flange and said wall flange to the bottom portion of said top flange, said tabs bendable at the bottom portion of said top flange to securably hold said elongated filler piece and a roofing membrane within the filler channel.

2. A roofing device according to claim 1, wherein said cap flashing, said top flange, said wall flange, and said tabs are all integrally formed from a single sheet of metal.

3. A roofing device according to claim 1, wherein the roofing device is pre-manufactured in a suitable size and shape to be positioned on an existing curb.

4. A pre-manufactured roofing device for sealing a roofing membrane to a roof comprising:

a base flange having a vertical portion and a horizontal portion, the horizontal portion adapted to be fixedly attached to the roof;

a curb piece attached to the vertical portion of said base flange;

a cap flashing having a vertical portion and horizontal portion, the horizontal portion of said cap flashing attached to the vertical portion of said base flange;

an inner support attached between the vertical portion of said base flange and the vertical portion of said cap flashing, said inner support disposed on top of said curb;

a top flange extending outward at an angle from the vertical portion of said cap flashing;

a wall flange extending downward from said top flange, said top flange and said wall flange defining a filler channel with said curb;

a drip edge flange extending outward at an angle from said wall flange;

an elongated resilient filler piece for snug insertion within the filler channel to secure the roofing membrane; and a plurality of tabs formed from said wall flange co-terminus with said drip edge flange, said tabs having a tab flange extending outward at the same angle as said drip edge flange and vertically cut from said drip edge flange and said wall flange to the bottom portion of said top flange, said tabs bendable at the bottom portion of said top flange to securably hold said elongated filler piece and a roofing membrane within the filler channel.

5. An improved roofing device for attaching a roofing membrane to a curbed roof having a cap flashing having vertical and horizontal portions, a top flange extending outward from the vertical portion of the cap flashing, a wall flange extending downward from the top flange, where the top flange and the wall flange for defining a filler channel with the curb when the cap flashing is attached thereto, a drip edge flange extending outward at an angle from the wall flange, and an elongated resilient filler piece for snug insertion within the filler channel, wherein the improvement comprises of a plurality of tabs formed from said wall flange, said tabs co-terminus to said drip edge flange having a tab flange extending outward at the same angle as said drip edge flange and vertically cut from said drip edge flange and said wall flange to the bottom portion of said top flange, said tabs bendable at the bottom portion of said top flange to securably hold said elongated filler piece and a roofing membrane within the filler channel.

6. A hatchway for a roof opening comprising:

a pre-manufactured roofing device according to claim 1, of suitable size and shape to be positioned on a curb to completely surround the roof opening; and a hatchway cover hinged to said roofing device for movement between an open and closed position.

7. A hatchway according to claim 6, further including a pre-manufactured curb suitable for mounting on a roof around a roof opening, said curb being of a mating size to said roofing device.

8. A hatchway according to claim 7, wherein said pre-manufactured curb and said roofing device form a factory-assembled unit.

9. A hatchway according to claim 7, wherein said pre-manufactured curb includes a horizontally extending base flange.

10. A hatchway according to claim 7, wherein said pre-manufactured curb comprises an inner surface and an outer surface.

11. A hatchway according to claim 10, wherein said outer surface is formed from a composition board material and said inner surface material is sheet metal.

* * * * *